United States Patent [19]

Nakaoka et al.

[11] 4,113,517

[45] Sep. 12, 1978

[54] METHOD OF MAKING COLD-REDUCED AL-KILLED STEEL STRIP FOR PRESS-FORMING BY CONTINUOUS CASTING AND CONTINUOUS ANNEALING PROCESS

[75] Inventors: Kazuhide Nakaoka; Kenzi Araki; Akihiko Nishimoto, all of Yokohama; Kozi Iwase, Machida; Haruo Kubotera, Yokohama, all of Japan

[73] Assignee: Nippon Kokan Kabushiki Kaisha, Tokyo, Japan

[21] Appl. No.: 713,793

[22] Filed: Aug. 12, 1976

Related U.S. Application Data

[63] Continuation-in-part of Ser. No. 548,522, Feb. 10, 1975, abandoned.

[30] Foreign Application Priority Data

Apr. 26, 1974 [JP] Japan ..... 49-46672

[51] Int. Cl.[2] ..... C21D 9/48

[52] U.S. Cl. ..... 148/2; 148/3; 148/12 C

[58] Field of Search ..... 148/12 C, 2, 3

[56] References Cited

U.S. PATENT DOCUMENTS

| | | | |
|---|---|---|---|
| 3,725,143 | 4/1973 | Alworth et al. | 148/36 |
| 3,839,095 | 10/1974 | Kubotera et al. | 148/2 |

*Primary Examiner*—W. Stallard

*Attorney, Agent, or Firm*—Moonray Kojima

[57] ABSTRACT

When an Al-killed steel consisting of, specially, 0.005% ≦ [N] ≦ 0.007%; 10 × [N] ≦ Sol.Al. ≦ 0.12%; and the ratio Sol.Al.%/[N]% controlled within the range of 10 to 20, is continuously cast, hot rolled, coiled at a high temperature, cold reduced and finally continuously annealed under special requirements, the steel strip is not at all inferior to the commercial base strip in mechanical properties and is made under high productivity and exhibits excellent uniformity in qualities.

3 Claims, 4 Drawing Figures

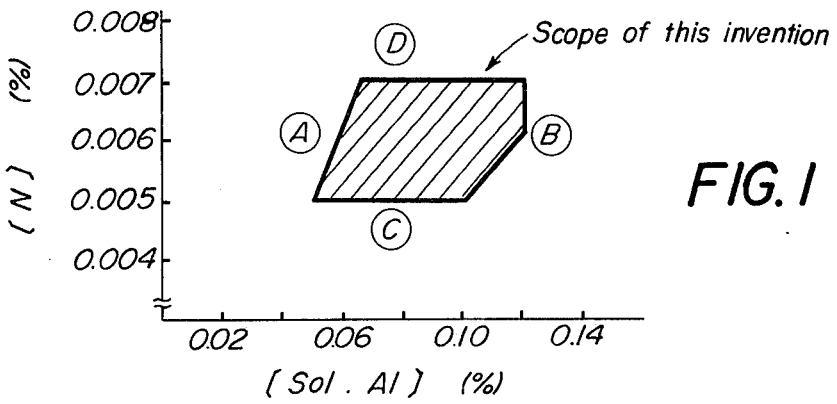
FIG. 1
FIG_2
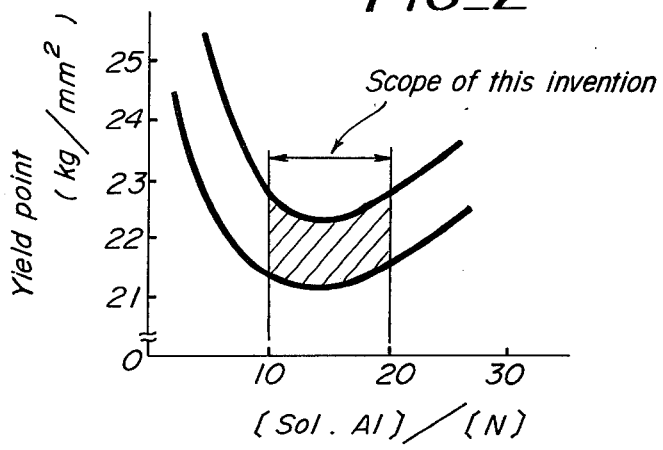
FIG_3
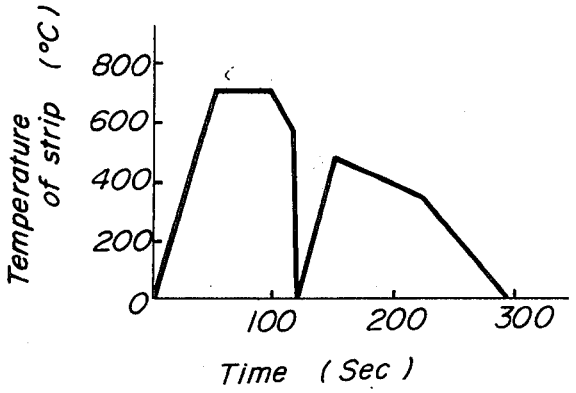
FIG_4
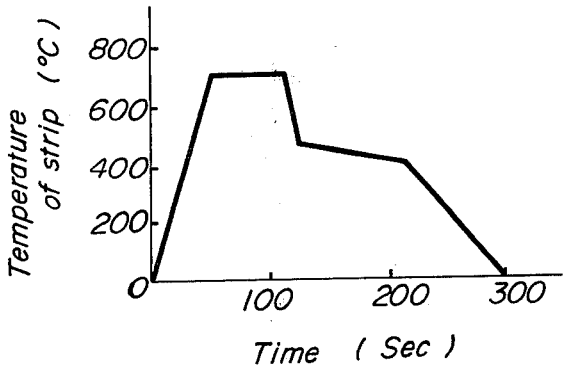

METHOD OF MAKING COLD-REDUCED AL-KILLED STEEL STRIP FOR PRESS-FORMING BY CONTINUOUS CASTING AND CONTINUOUS ANNEALING PROCESS

This is a continuation in part of Ser. No. 548,522 filed Feb. 10, 1975, and now abandoned.

BACKGROUND OF THE INVENTION

The present invention concerns a method of making cold reduced Al-killed steel strips and sheet suitable for press forming by a continuous casting and continuous annealing process. More particularly, the present invention concerns a method of making a steel strip whose mechanical properties are not inferior to those of a steel sheet made by the batch type annealing process by means of controlling [N] %, Sol. Al. % and Sol-.Al.%/[N]% ratio in the steel making stage.

A continuous casting process is advantageous in that the casting operation may be performed continuously with a consequent saving of manpower, the yield point is improved and uniform quality is obtainable. It has rapidly and widely come to be used in recent years. The steel widely used in continuous casting process for making cold reduced steel sheets is low carbon A1-killed steel having the general composition: C = 0.04 to 0.06%, Sol.AL. = 0.020 to 0.040%; N= 0.005 to 0.007%, Mn = 0.20 to 0.50%; P = 0.007 to 0.020%; an S = 0.010 to 0.030%.

Except for Sol. Al. and Mn, the above components are unavoidable in steel. The [N] is higher than that of Al-killed steel made in accordance with ordinary ingot making (0.003 to 0.005% [N]), because the molten steel is apt to come in contact with air more frequently between ladle and tundish, in the tundish and between the tundish and casting mold in the continuous casting process. The reason for controlling the Sol. Al content within the range of 0.020 to 0.040% is that advantageous results can be obtained in the form of steel sheet having excellent press-formability since the Lankford value is high and the yield point is low if the Sol. Al content is within said range. In the case of batch type annealing, when the aforementioned [N] range and Sol. Al range are used comparable results are not obtained. The reason for controlling the Mn content to 10 × [S]% to 0.50% is to avoid red shortness caused by S in steel by forming MnS.

The conventional continuous annealing process known in the art requires a shorter period of time for the steel to remain in the furnace than in the case of the batch type annealing process, and uses rapid heating and cooling. The steel sheet obtained by this annealing process has a low strain aging property and a high yield point and is not suitable for press forming. For these reasons, it is well known that it is mainly used for tin plate. However, the utility value of annealed cold reduced steel strip for press forming will be unlimited in view of the continuous annealing process, remarkable merits of the continuous annealing process for high efficiency in production and uniformity in quality once the above mentioned defects in the continuous annealing process have been rectified.

Until now the continuous process for obtaining a soft steel strip was proposed in U.K. Pat. No. 1,334,022 as a continuous annealing process for low carbon cold reduced soft steel strip for press forming which is characterized in that the cold reduced low carbon steel strip is heated, quenched, continuously passed through a furnace equipped with a heating zone, heated the strip up to 1,250° to 1,300° F in said heating zone, quenched the same to below 1,000° F from the above temperature range in said quenching zone, e.g. at a rate of 50° C/sec, and successively held the strip for at least 30 seconds within a temperature range of 800° to 1,000° F in the shelf treating zone. However, the problem encountered in the above mentioned U.K. Patent process was that the shelf treatment continuous annealing given to continuously cast Al-killed steel having the above mentioned composition would never yield the steel sheet having the press formability of the commercial grade cold reduced steel sheet obtained by the batch type annealing process.

Generally, the properties required for a cold reduced steel sheet for press formability for it to be of commercial grade are as follows:

(1) it should have a low yield point (to be soft) and (2) it should have excellent strain aging properties.

The standards as regards the above mentioned properties of the commercial grade cold reduced steel sheet produced in the conventional batch type annealing process (Japanese Industrial Standards, G-3141, similar to ASTM A-109) are:

Yield Point = 22 to 23 kg/mm$^2$

After tempering = reappearance of yield point elongation after 38° C × 8 days aging is 1.5% or less.

If a steel continuously cast suitable for a continuous annealing process including shelf treating is developed under the present circumstances, process for the production of cold reduced steel strip from the steel making to the annealing is carried out by a continuous operation and its industrial merits will naturally be evaluated most highly.

SUMMARY OF THE INVENTION

The present invention aims to overcome the aforementioned and other problems and disadvantages of the prior art, and is characterized in that the Sol. Al content, the [N] content and the Sol.Al%/[N] % ratio are controlled respectively within the specified ranges in the continuously cast Ai-killed steel.

An object of the invention is to provide an Al-killed steel strip made by a continuous casting and continuous annealing process having a press formability which is not inferior to that of the ordinary Al-killed steel made by batch type annealing process.

Another object of the invention is to make best use of the continuous annealing process for Al-killed steel made by the continuous casting process.

According to the present invention, there is provided a method of making an Al-killed cold reduced steel strip and sheet suitable for press forming which method comprises steel making, hot rolling including coiling at a high temperature therein, pickling and cold reducing, and continuous annealing including shelf treating therein, steel whose chemical composition is controlled as follows: [N] % = 0.005% ≦ [N] ≦ 0.007%; Sol. Al % = 10 $x$[N] % ≦ Sol.Al ≦0.12% and ratio Sol-.Al%/[N] % = 10 to 20.

It is preferable that coiling is performed at a temperature within the range of 700° C to 780° C and that the [N] % content and the ratio of Sol. Al%/[N] % are controlled in the continuous casting step.

Other objects and advantages will be apparent from the following description and the accompanying drawing.

BRIEF DESCRIPTION OF DRAWING

FIG. 1 shows the relationship between the Sol. Al and [N] contents in steels of the invention.

FIG. 2 shows the relationship between yield point and Sol. Al%/[N] % ratio in the steel of the invention.

FIGS. 3 and 4 are typical continuous annealing cycles available in this invention.

DETAILED DESCRIPTION OF PREFERRED EMBODIMENTS

From FIG. 1 it is apparent that the [N] content and the Sol. Al content in the steel should be: 0.005% ≦ [N] ≦ 0.007%; and 10 × [N] % ≦ Sol. Al ≦ 0.12%. In FIG. 1, the border line (A) corresponds to Sol. Al%/[N] % = 10, and is based on the fact that the larger the Sol. Al%/[N] % ratio becomes the lower the yield point becomes. The relationship between such ratio and the yield point has its optimum range as shown in FIG. 2. If the ratio increases further, then it will cause the yield point to rise. In other words when the ratio of Sol. Al%/[N] % is within the range of 2–15, the yield point will decrease as said ratio is increased and conversely if said ratio exceeds 15, it will gradually raise the yield point. Thus, it has been confirmed that the above mentioned ratio should be within the range of 10 to 20, to obtain the yield point of commercial grade cold reduced steel sheet. The border line (B) in FIG. 1 shows such an upper limit. It has been found that the yield point decreases as the Al%/[N]% ratio is increased within the range of 2–15 because the increase in Sol.Al %/[N]% ratio leads to the more sparse distribution of AlN precipitation and results in good grain growth during continuous annealing. It the ratio continues to be increased and exceeds 15, then solute Al content increases and solid solution hardening thereby tends to be brought about and, consequently, the raising of the yield point becomes unavoidable. The upper limit of the Sol. Al content was set in view of the raising of the yield point and operating efficiency at the time of continuous casting. That is to say, if the Sol. Al content exceeds 0.12% or the Sol.Al/[N] ratio exceeds 20, the nozzle for pouring the molten steel into the casting molds becomes clogged and causes difficulties in operation.

The lower limit of [N]% is rather high as shown in FIG. 1 as the border (C) ≧ 0.005%. It should be noted that the percents herein are in terms of weight unless otherwise stated. This is a requirement for reducing the deterioration of the properties at the coil ends. As will be discussed later, the outer and the inner peripheries of the coil, i.e. the coil ends are cooled faster than its middle portion when the steel is coiled at a high temperature after final hot rolling, and self-annealing effects of the coil become difficult to obtain and said [N] tends to be unable to precipitate as AlN completely. This exerts undesirable influences on the strain aging property. That is why [N] % in steel is controlled to [N]≦ 0.005%. However, too high a [N]content raises the yield point, consequently the same level in property as that of ordinary steel becomes difficult to obtain. Therefore, the upper limit is set at [N] ≦ 0.007%. This is shown in FIG. 1 as the border line (D). Thus, the range of 0.005% ≦ [N] ≦ 0.007% is the optimum range for making easy precipitation of AlN in the favourable self-annealing dependent upon coiling at a high temperature.

A similar consideration may be taken as for ordinary ingot making process in respect to C, P, S, and Mn, C, P and S contents should preferably be as low as possible and Mn should be 0.20 – 0.50% in order to avoid red shortness. In order to positively lower the C content, a degassing process may be included between the steel making process and the continuous casting process.

The continuously cast slab having the above mentioned composition is coiled at a high temperature after ordinary hot rolling. The coiling temperature here should be selected to be above 680° C. This is an indispensible requirement for the continuous annealing process which has little time to fix solute [N] in steel as AlN. The self-annealing of coil which has been coiled at such a high temperature leads to sufficient precipitation of AlN and the generation of strain aging may be prevented. This is quite the opposite of the ordinary batch type annealing. That is, in the batch type annealing, the strip is coiled at a temperature below 600° C. In order to restrain the precipitation of AlN in the hot rolling stage, and then AlN is precipitated during the ordinary annealing process. The high temperature coiling employed is markedly in contrast to the batch type annealing process and is one of the indispensible requirements of this invention.

The strip thus coiled at a high temperature is then subjected to pickling and cold-reducing processes. The pickling and cold reducing processes do not require any special care and may be performed in the ordinary manner. The cold reduced strip is annealled continuously. In the continuous annealing process in accordance with the present invention, a treating zone for precipitating carbide in steel is included. Various carbide precipitation treatments are known in the art, but the heat cycles recommended in this invention are represented by the curves in FIGS. 3 and 4. It is readily possible to obtain the properties of the commercial grade steel sheets with either one of the above cycles, the selection of either depending on the various conditions such as actual continuous annealing facilities. Details of the heat cycles will be discussed in relation to the following examples.

EXAMPLE 1

TABLE 1

| | Chemical Composition | | | | | | |
|---|---|---|---|---|---|---|---|
| | | | Sol.Al / [N] | | | | |
| | Sol.Al | [N] | [N] | C | Mn | P | S |
| Steel 1 | 0.029 | 0.0058 | 5.0 | 0.052 | 0.35 | 0.009 | 0.022 |
| Steel 2 | 0.045 | 0.0055 | 8.2 | 0.043 | 0.30 | 0.012 | 0.018 |
| Steel 3 | 0.065 | 0.0068 | 9.6 | 0.049 | 0.33 | 0.011 | 0.020 |
| *Steel 4 | 0.078 | 0.0054 | 14.4 | 0.057 | 0.25 | 0.010 | 0.015 |
| *Steel 4-1 | 0.069 | 0.0057 | 12.2 | 0.052 | 0.17 | 0.010 | 0.017 |
| Steel 5 | 0.078 | 0.0079 | 9.9 | 0.055 | 0.38 | 0.013 | 0.023 |
| *Steel 6 | 0.079 | 0.0052 | 15.2 | 0.008 | 0.38 | 0.010 | 0.017 |
| *Steel 6-1 | 0.111 | 0.0060 | 18.5 | 0.045 | 0.20 | 0.012 | 0.020 |

Note:
*denotes inventive steels.

The continuously cast slabs having the above chemical compositions were subjected to hot rolling, high temperature coiling, pickling, cold reducing, continuous annealing and temper rolling.

The major requirements in respective stages are as follows:

| | | |
|---|---|---|
| Hot rolling | finishing thickness | 3.2 mm |
| Hot rolling | finishing temperature | 850° C |
| Hot rolling | coiling temperature | 700° C |
| Cold reducing | final thickness | 0.8 mm |

Continuous annealing cycle (as shown in FIG. 3). That is (1) Strip is heated to 720° C, from ambient temperature.
(2) It is held for 40 seconds at 720° C.
(3) It is cooled down to 595° C at rate of about 7° C/sec.
(4) It is rapidly cooled down to room temperature from 595° C by water quenching.
(5) It is re-heated to 490° C.
(6) It is cooled from 490° C to 350° C at rate of about 2° C/sec.
(7) It is cooled from 350° C to ambient temperature at rate of about 5° C/sec.

Temper rolling = 1%.

The above is one example of the heat cycle as shown in FIG. 3. The next is an outline of respective steps in the continuous annealing cycle including shelf treating used in the present invention and the actual heat cycle should be selected from the following.

(1) The strip is heated from ambient temperature to a temperature above recrystallization temperature but below 800° C, preferably 700–730° in 30 to 90 seconds.
(2) The strip is held for 30 to 90 seconds at the above heating temperature.
(3) It is then cooled down to 550° to 650° C, at a rate of less than 30° C/sec.
(4) It is quenched from 550° to 650° C to ambient temperature at a rate of more than 200° C/sec.
(5) It is pre-heated to 300° to 500° C, preferably 400° to 500° C.
(6) It is then slowly cooled, but is held within this temperature. More precisely, the steel should be held for 30 to 180 seconds at a temperature within the range of 300 to 500° C.
(7) There is no specific limitation placed on the cooling rate from the above temperature to ambient temperature, but a rate of 3° to 17° C/sec is recommended.

In application of such shelf treatment process, requirements for respective steps are suitably selected and combined, and the above heat cycle is one example of such combination.

The steels 1 to 5 listed in Table 1 are slabs made by LD converter-continuous casting process. Steels 6 and 6-1 are slabs made by LD converter-DH degassing-continuous casting, with lower C content because of the degassing treatment. The mechanical properties of the steels 1,2 and 3 and steel 5 are not good because steel 1, 2 and 3 has too low Sol.Al/[N] ratio, and steel 5 has too high [N] content, while the inventive steels 4, 4-1, 6, 6-1 satisfy the range of the composition required of the invention.

The mechanical properties obtained are shown in Table 2.

TABLE 3

| | Properties | | | |
|---|---|---|---|---|
| | Yield Point (kg/-(kg/-mm²) | Tensile at ambient strength (kg/mm²) | Total elon-gation (%) | Yield Point elongation (%) after temperature for 3 months. |
| Steel 1 | 25.5 | 35.6 | 45.8 | 0.2 |
| Steel 2 | 22.3 | 33.4 | 46.2 | 0.3 |
| Steel 3 | 23.0 | 34.0 | 45.3 | 0.2 |
| *Steel 4 | 21.2 | 33.0 | 45.5 | 0.4 |
| *Steel 4-1 | 21.7 | 33.1 | 45.9 | 0.2 |
| Steel 5 | 24.0 | 35.1 | 43.5 | 0.2 |

TABLE 3-continued

| | Properties | | | |
|---|---|---|---|---|
| | Yield Point (kg/-(kg/-mm²) | Tensile at ambient strength (kg/mm²) | Total elon-gation (%) | Yield Point elongation (%) after temperature for 3 months. |
| *Steel 6 | 20.2 | 32.0 | 47.2 | 0.7 |
| *Steel 6-1 | 21.5 | 33.0 | 46.0 | 0.3 |

Note:
*denotes inventive steels.

The steels in accordance with the present invention all show low yield points of the commercial grade cold reduced steel sheet, and in particular inventive steel 4 having a high Sol.Al/[N] ratio and inventive steel 6 having low carbon content and a high Sol.Al/[N] ratio show excellent mechanical properties. The steels 1,2,3 and 5 outside the range of the present invention were found unserviceable for the commercial grade cold reduced steel sheets because of their high yield points (more than 22.3 kg/mm² and above) Steels 4 and 6 have good yield point after aging. None of the steels presented problems in respect of strain aging properties.

EXAMPLE 2

The continuous annealing process including the shelf treating step in accordance with the following heat cycle as shown in FIG. 4 was given to the steels processed using the same requirements as those in EXAMPLE 1 up to the cold reducing.

(1) The strip is heated from ambient temperature to 710° C.
(2) It is held for 60 seconds at 710° C.
(3) It is rapidly cooled from 710° C to 490° C at rate of 15° C/sec.
(4) It is slowly cooled from 490° C to 400° C at a rate of 1° C/sec.
(5) It is cooled from 400° C to ambient temperature at a rate of 5° C/sec.

Such a shelf treating step in the continuous annealing process is one example of actual heating cycles shown in FIG. 4, but basically it is similar to that used for Example 1 or FIG. 3. However, respective steps differ considerably from each other and may be summarized as:

(a) The starting temperature of rapid cooling for this example is higher than that of Example 1, i.e. 710° C.
(b) The rapid cooling rate is different from that of the water quenching in Example 1, and is within the range of the rate of accelerated cooling such as by gas.
(c) Because of the comparatively slow cooling rate, the control of the terminal temperature of cooling is easy, and accordingly it is possible to stop the cooling at the required temperature for carbide precipitation. The required carbide precipitation temperature is easily obtained and there is no need for re-heating as in the case of Example 1. In other words, the process is very suitable for application to the continuous annealing line which has no water quenching equipment and no re-heating zone.

The mechanical properties obtained by the above heat cycle and temper rolling of 1% are as follows.

TABLE 3.

| | Mechanical Properties | | | |
|---|---|---|---|---|
| | Yield Point (kg/mm²) | Tensile strength (kg/mm²) | Total Elongation (%) | Yield point elongation (%) after aging at ambient Temp. for 3 months. |
| Steel 1 | 25.1 | 35.3 | 46.0 | 0.4 |
| Steel 2 | 22.0 | 33.3 | 46.0 | 0.5 |
| Steel 3 | 22.5 | 33.0 | 45.5 | 0.5 |
| *Steel 4 | 20.8 | 32.5 | 45.8 | 0.4 |
| *Steel 4-1 | 21.2 | 32.7 | 45.9 | 0.5 |
| Steel 5 | 23.7 | 35.0 | 43.5 | 0.5 |
| *Steel 6 | 19.7 | 31.7 | 48.0 | 0.9 |
| *Steel 6-1 | 20.9 | 32.7 | 46.0 | 0.6 |

Note:
*denotes inventive steels.

The above table reveals that steels 1,2,3,5 whose compositions are outside the range of the present invention also show high yield points and are not suitable for commercial grade steel sheet even when they have been processed by the shelf treatment such as the present Example 2. Compared to Example 1, the recovery of yield point elongation after aging is found to be large. This naturally is based on the differences of the shelf treatment processes. Accordingly, it is suggested that Example 1, i.e. the shelf treating process in FIG. 3, should be applied when retarded-aging property is desired.

EXAMPLE 3

The continuously cast slab having the same chemical composition as that of Example 1 is subjected to hot rolling, high temperature coiling, pickling, cold reducing, continuous annealing including shelf treatment and temper rolling. The major requirements in respective processes are similar to those of Example 1 except in the hot rolling stage. The requirements in the hot rolling stage are as follows:

Finishing thickness 3.2 mm
Finishing temperature 870° C
Coiling temperature 780° C.

The mechanical properties of the steel sheet thus obtained are shown in Table 4.

TABLE 4

| | Mechanical Properties | | | |
|---|---|---|---|---|
| | Yield Point (kg/mm²) | Tensile Strength (kg/mm²) | Total elongation (%) | Yield Point. Elongation (%) after aging at ambient temp for 3 months. |
| Steel 1 | 24.6 | 35.1 | 44.8 | 0.2 |
| Steel 2 | 21.4 | 32.9 | 45.5 | 0.1 |
| Steel 3 | 22.0 | 33.1 | 44.2 | 0.2 |
| *Steel 4 | 20.1 | 32.4 | 44.6 | 0.3 |
| *Steel 4-1 | 20.5 | 32.7 | 45.0 | 0.3 |
| Steel 5 | 23.7 | 34.7 | 41.6 | 0.3 |
| *Steel 6 | 19.4 | 31.1 | 47.9 | 0.5 |
| *Steel 6-1 | 20.7 | 32.9 | 44.9 | 0.3 |

Note:
*denotes inventive steels.

Table 4, reveals that the mechanical properties are better than those in the case of Example 1 if the coiling temperature is raised to 780° C. However, steels 1,2,3 and 5 which are outside the range of the present invention in chemical composition showed a high yield point, accordingly, not suitable for the above commercial grade cold reduced steel sheet even when the coiling temperature was raised to 780° C.

The above mentioned desription was not unfolded on condition of a continuous casting process. This reason lies in that the required [N]%, Sol. Al% and ratio of Sol.Al%/[N] % are easily obtained in the continuous casting process as mentioned above. It is, however, needless to say that the above contents and ratio can be controlled in the steel making process and accordingly an ordinary ingot making and slabbing process also may be employed. In any case, when said [N] %, Sol. Al % and Sol.Al%/[N] % ratio are controlled within the range of this invention, respectively, manufacture of a strip and sheet having good mechanical properties and not being inferior to the ordinary commercial base strip and sheet made by batch type annealing process is possible by a continuous annealing process with ease and stability.

The foregoing description is illustrative of the invention; numerous other embodiment and modifications thereof would be apparent to the worker skilled in the art. All such modifications and embodiments are to be considered to be within the spirit and scope of the invention.

What is claimed is:

1. An improved method of making a press-formable cold reduced, Al-killed steel strip having low yield point and retarded aging properties, comprising the steps of selectively controlling Nitrogen and Soluble Aluminum in the usual chemical composition of Al-killed steel in such a manner that the ratio of Sol. Al/N is within the range of 10 to 20 with N content being $0.005\% \leqq N \leqq 0.007\%$; and Sol. Al content being $10 \times N\% \leqq$ Sol. $\leqq 0.12\%$;

continuously casting said molten steel;

coiling, at the rolling stage, said steel strip at a temperature within the range of 700° C to 800° C to effect self-annealing; and introducing the thusly treated steel strip into a continuous annealing process including an overaging treatment, said annealing process comprising the steps of (A) heat from ambient temperature to 700 to 730° in 30 to 90 seconds;

(B) holding at the temperature of step (A) for 30 to 90 seconds;

(C) cooling at the rate of less than 30° C/sec to 550 to 650° C;

(D) rapidly cooling from the temperature of step (C) at the rate of more than 200° C/sec to ambient temperature;

(E) reheating to a temperature within the range of 300 to 500° C;

(F) slowly cooling from the temperature of step (E) but held within the range of 300 to 500° C for 30 to 180 seconds; and (G) cooling at the rate of 3 to 170° C/sec.

2. The method of claim 1, wherein the range of temperature attained in step (E) is from 400 to 500° C.

3. An improved method of making a press-formable cold reduced, Al-killed steel strip having low yield point and retarded aging properties, comprising the steps of selectively controlling Nitrogen and Soluble Aluminum in the usual chemical composition of Al-killed steel in such a manner that the ratio of Sol. Al/N is within the range of 10 to 20, with N content being $0.005\% \leqq N \leqq 0.007\%$; and Sol. Al content being $10 \times N\% \leqq$ Sol. Al $\leqq 0.12\%$;

continuously casting said molten steel;

coiling, at the hot rolling stage, said steel strip at a temperature of more than 700° C to effect self-annealing; and introducing the thusly treated steel strip into a continuous annealing process including an overaging treatment, said annealing process comprising the steps of (A) heating to 700° to 730° C;

(B) holding at the temperature of step (A) for 30 to 90 seconds;

(C) rapidly cooling from the temperature of step (B) to about 490° C at the rate of 15° C/second;

(D) slowly cooling from 490° C to 400° C at the rate of 1° C/sec and (E) cooling from 400° C to ambient temperature at the rate of 5° C/sec.

* * * * *